US005600921A

United States Patent [19]

Vardaro

[11] Patent Number: 5,600,921

[45] Date of Patent: Feb. 11, 1997

[54] BULKHEAD DOOR ASSEMBLY

[76] Inventor: William L. Vardaro, 21 Farmhouse Rd., Bedford, N.H. 03110

[21] Appl. No.: 300,529

[22] Filed: Sep. 6, 1994

[51] Int. Cl.[6] ..... E06B 1/00; E05F 1/10

[52] U.S. Cl. ..... 49/380; 49/379; 49/386

[58] Field of Search ..... 49/380, 379, 386, 49/401, 402, 501; 52/19, 20, 21

[56] References Cited

U.S. PATENT DOCUMENTS

| | | | |
|---|---|---|---|
| 270,635 | 12/1883 | Castor . | |
| 443,962 | 12/1890 | Golden . | |
| 739,301 | 9/1903 | Fountain . | |
| 768,869 | 8/1904 | Symons . | |
| 794,968 | 7/1905 | Baldwin . | |
| 1,085,657 | 2/1914 | Appleton . | |
| 2,100,124 | 11/1937 | Gilpin | 52/19 |
| 2,137,751 | 11/1938 | Davis . | |
| 2,174,989 | 10/1939 | Lyons . | |
| 2,239,033 | 4/1941 | Cartmill | 52/19 |
| 2,257,791 | 10/1941 | Edmister . | |
| 2,607,302 | 8/1952 | Nystrom | 49/401 X |
| 2,686,340 | 8/1954 | Shepard et al. | 49/386 |
| 2,733,483 | 2/1956 | Anderson | 49/386 |
| 2,871,056 | 1/1959 | Levitt | 49/401 X |
| 2,978,755 | 4/1961 | Walker | 49/401 |
| 3,561,162 | 6/1969 | Goldman . | |
| 3,665,661 | 5/1972 | Beckerer . | |
| 3,849,951 | 11/1974 | Howle . | |
| 3,896,595 | 7/1975 | Anghinetti et al. . | |
| 4,185,415 | 1/1980 | LaConte . | |
| 4,845,905 | 7/1989 | Frank . | |
| 4,873,791 | 10/1989 | Lyons, Sr. . | |
| 5,067,277 | 11/1991 | Magalotti | 49/386 |
| 5,205,073 | 4/1993 | Lyons, Sr. . | |

OTHER PUBLICATIONS

Goal! Inc., *Hatchway Steel Basement Doors Installation Instructions*, 1990, pp. 1–7.

The Bilco Co., *How to Add Direct Basement Access*, Form No. C 650, 1993–1, pp. 1–8.

The Gordon Corporation, *Replace your basement door easily and economically with Gordon steel basement doors*, date unknown.

The Bilco Co., *Bilco Door Installation Information*, eff. Aug. 17, 1993, D–1, D–2.

AVM, Inc., Strongarm, *Lift Supports*, p. 106, date unknown.

Stabilus, *Gas Spring Products* . . . , (Product Catalog) 1991.

Palmer River Products, Inc., The Clamdoor Bulkhead, *A breakthrough in bulkheads* . . . . (Advertising Brochure), date unknown.

*Primary Examiner*—Philip C. Kannan

[57] ABSTRACT

A fiberglass, insulated bulkhead door assembly overcomes the limitations of conventional wooden and metallic storm doors. A preassembled bulkhead door assembly is positioned atop a preexisting concrete foundation. Once in place, the bulkhead forms a liquid tight barrier. As an insulated, lockable structure, the bulkhead door assembly provides a means of ingress into and egress out of a basement of a dwelling structure. The base support and door of the bulkhead door assembly incorporate an insulative layer sandwiched between a pair of molded fiberglass panels, which are then covered by a durable gel coat finish. The combination of insulation and fiberglass maintains an effective thermal barrier between the basement of the dwelling structure and an exterior environment. A pair of pneumatic struts counterbalance the door into an upright position.

17 Claims, 3 Drawing Sheets

BULKHEAD DOOR ASSEMBLY

FIELD OF THE INVENTION

The present invention relates to doors and doorway assemblies for providing access to a building or structure. More particularly, the present invention relates to a bulkhead door assembly providing a means of ingress into and egress out of a basement of a dwelling structure.

BACKGROUND OF THE INVENTION

Cellar doors, storm doors, trap doors, and hatchways have provided ingress and egress for basements of dwelling structures for over a century. Doorways such as these have been commonly added to buildings as an after-thought and accordingly have been configured in such a manner so as to reduce the amount of construction involved. Further, these types of doorways have generally provided access to a safe haven for occupants during thunder showers, blizzards and tornadoes. Accordingly, it is desirable for these doorways to have a low profile in order to reduce the adverse effects brought on by the elements.

Inventors have focused upon improvements to the traditional storm door for over 100 years. W. S. Castor, U.S. Pat. No. 270,635, disclosed in 1883 a counter-balanced storm door having a foot operated releasing mechanism. The Castor storm door was made out of wood and incorporated a mechanical swinging element/spring assembly to assist movement of the door into a standard upright position.

Additional patents have outlined the evolution of the conventional storm door adding various improvements thereto. Golden, U.S. Pat. No. 443,962, discloses a device for raising and lowering cellar doors. A crank arm in the form of a bent rod is used to urge a wooden door from a closed position to an open position. Similarly, Baldwin, U.S. Pat. No. 794,968, discloses a wooden cellar door in which a counter balanced weight is used to urge the door into an upright position. Lyons, U.S. Pat. No. 2,174,989, discloses a metallic dual door hatchway for providing access to the basement of a structure. Lyons further discloses that a lock, handle, and metallic hinge mechanism may be used in accordance with the hatchway door structure.

The Lyons disclosure is quite similar to FIG. 1 of the present invention which shows a dual door metallic storm door. FIG. 1 shows that the conventional storm door has changed little over the last 50 years. In the conventional design, as shown, a pair of heavy metallic doors cooperate to form an entryway into a basement of a dwelling. The doors and assembly are not insulated and provide little thermal protection from the environment.

Howle, U.S. Pat. No. 3,849,951, discloses a slidable storm door and associated door frame for mounting above a storm cellar. A roller mechanism cooperates with the dual door structure to move one door within a recess provided by the other. Accordingly, the second door or "protective panel" functions as the door assembly. A locking means is also provided.

Lyons Sr., U.S. Pat. No. 4,873,791, discloses in his patent dated Oct. 17, 1989, a conventional dual door storm door assembly incorporating a torque rod and counter balancing hinge assembly. The torque rod and hinge assembly cooperate to provide linear torque to the storm doors such that they may be "balanced" in any position, i.e., between 0° and 90° of opening. Lyons, Sr. seeks to overcome the problems of conventional metallic doors which are heavy and cumbersome to operate.

SUMMARY OF THE INVENTION

The present invention overcomes many of the limitations of the prior wooden and metallic storm doors by taking advantage of modern materials and manufacturing techniques. The present invention also incorporates several novel features which may be combined into a prefabricated bulkhead assembly. The bulkhead assembly is positioned atop a preexisting concrete foundation. Once in place, through suitable cement placement and anchoring means, the bulkhead assembly forms a moisture proof barrier, and an insulated, lockable structure. This provides security and an effective means of ingress into and egress out of the basement of a dwelling structure. The foundation of the bulkhead incorporates an insulative layer sandwiched between a pair of fiberglass panels. The fiberglass panels are then covered by a durable gel coat finish. The combination of insulation and fiberglass maintains an effective thermal barrier between the basement of the dwelling structure and an exterior environment.

The bulkhead door has a base support with a peripheral flange for connection to a building foundation. A pair of sidewalls are integrally connected to alternate sides of the base support and extend upwardly therefrom. A header panel is also integrally connected with the upwardly extending sidewalls. An elongated door having a distal end and a proximal end is rotatably connected to the header panel about a first hinge member. The bulkhead door also incorporates an insulated substrate sandwiched between a fiberglass top and bottom panel.

A bulkhead door assembly provides a means of ingress into or egress out of a structure. A base support having a peripheral flange is connected to a building foundation. A pair of upwardly extending sidewalls integrally connect alternate sides of the base support. A header panel integrally connects the pair of upwardly extending sidewalls. An elongated door has a distal end and a proximal end, wherein the distal end is rotatably connected to the header panel about a first hinge member. The elongated door further comprises an insulating substrate sandwiched between a top panel and bottom panel. A footer panel is integrally connecting the pair of upwardly extending sidewalls at the proximal end of the door assembly to define an opening within said bulkhead door assembly.

The bulkhead door assembly further includes a peripheral recess integrally formed therein. The peripheral recess houses a resiliently deformable gasket. A peripheral bead surrounds the opening within the bulkhead door assembly and has an outward surface, an inward surface and a bearing surface. The bearing surface contacts the peripheral recess via the deformable gasket. A resilient compression member in the form of a pneumatic strut telescopically joins the elongated door and a first one of said pair of upwardly extending sidewalls. A second resilient compression member may also be used. A lock assembly is formed within the elongated door for securably joining the elongated door to said base support.

DETAILED DESCRIPTION OF THE PREFERRED EMBODIMENT

Figure 2:
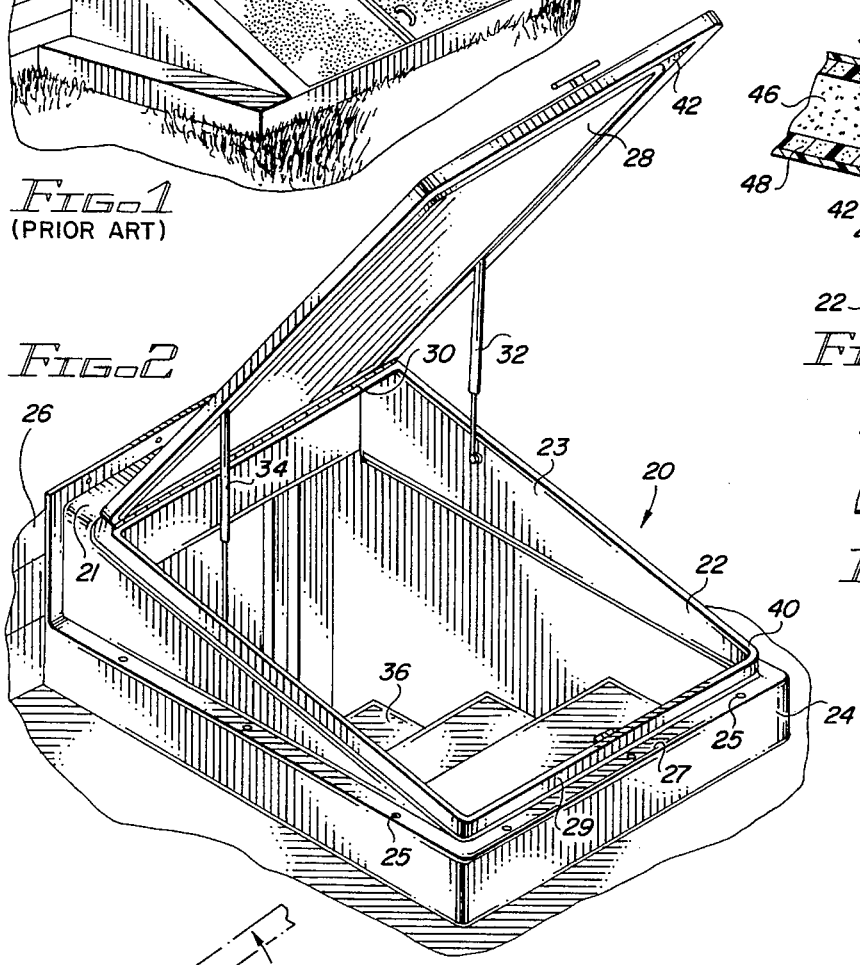
FIG. 2 is an elevated perspective view of a bulkhead assembly according to the present invention with a single door shown in an upright position.

Referring now to the drawings and in particular FIG. 2, an elevated perspective view of a bulkhead door assembly 20, in accordance with the present invention is shown. The bulkhead door assembly 20 includes a base support 22 which is fastened to a foundation 24 and a side of a dwelling structure 26. An elongated door 28 is fastened to the base support 22 about a hinge member 30. A pair of pneumatic struts 32 and 34 urge the elongated door into the fully upright position.

Pneumatic struts or shocks 32 and 34 provide a counterbalance to urge elongated door 28 into the upright position. Struts 32 and 34 are self locking into an infinite number of positions ranging from fully extended to fully compressed. Alternatively, struts 32 and 34 may be of alternate construction such as oil filled or a spring/damper combination.

In further reference to FIG. 2, foundation 24 may be either a foundation jog, i.e., an outward projection from a portion of a foundation designed to support the dwelling structure, or may be a pre-cast concrete wall. Further, the wall may be made from rubble, stone, or masonry. A patch of mortar is generally applied atop the foundation to provide a smooth even surface for affixing the structure. Bolts are generally secured within the foundation to provide an anchor support for the bulkhead door assembly.

A plurality of bolt holes 25 are shown disposed about the periphery of base support 22. Bolt flange 27 provides a supporting structure for bolt holes 25. Bolts (not shown) may pass from either the side of dwelling structures 26 or from foundation 24 and engage a nut and washer assembly to thereby secure bulkhead door assembly 20 to the foundation.

Base support 22 has a molded upper surface 23 which defines an opening and provides a means of ingress into or egress out of the lower level of the structure. Molded upper surface 23 includes header panel 21, footer panel 29, peripheral bead 40, and the supporting structure as shown.

It is anticipated that the bulkhead door assembly 20 will cover a plurality of descending steps 36. Descending steps may be formed integrally with the foundation 24, or formed onto the compacted earth below. The steps may be of wooden or metallic design and fastened to the sides of foundation 24 with a pair of stair stringers which are well known in the art. Although not shown, a second door may be provided at the end of descending steps 36 to provide a second insulative barrier from the elements.

Figure 1:
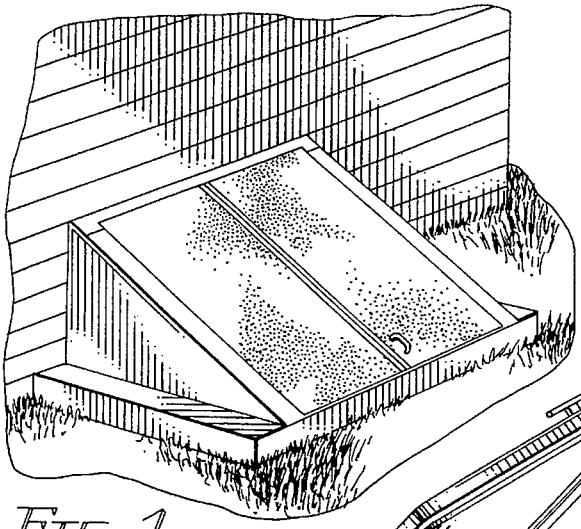
FIG. 1 (PRIOR ART)
FIG. 1 (prior art) is an elevated perspective view of a conventional metallic storm door assembly having a dual door configuration.

The single elongated door design having a continuous or "piano" hinge at a distal end thereof has been found to have numerous advantages over the prior art. The single door design reduces water leakage and reduces air infiltration over and above the prior art as shown in FIG. 1.

Figure 3:
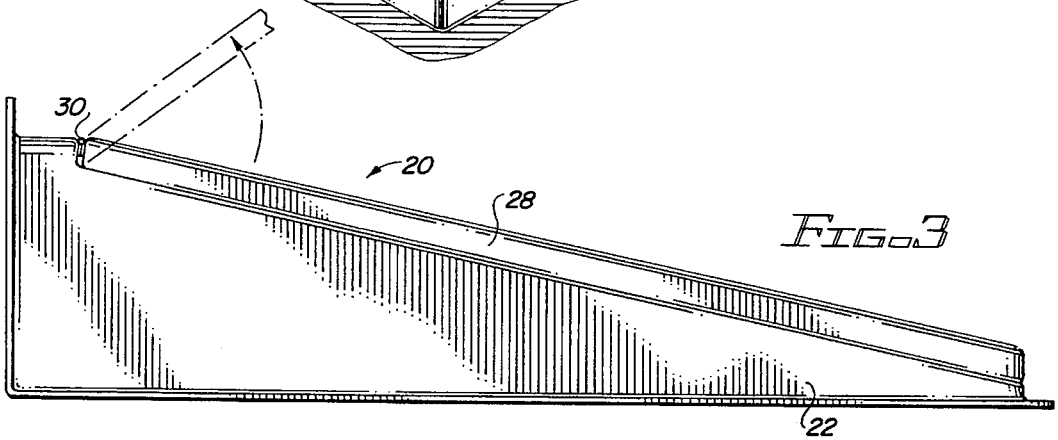
FIG. 3 is a side view of the bulkhead assembly showing movement of an entry door with respect to a base support.

FIG. 3 is a side view of the bulkhead door assembly 20 showing the elongated door 28 mounted atop base support 22. An arrow indicates movement of the elongated door 28 about hinge member 30 in relation to the base support 22.

Figure 6:
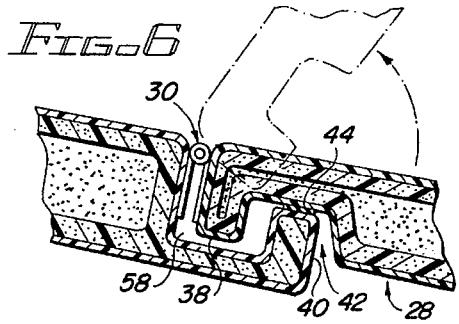
FIG. 6 is a detail side-sectional view of the base support and the elongated door of a proximal end thereof.
Figure 5:
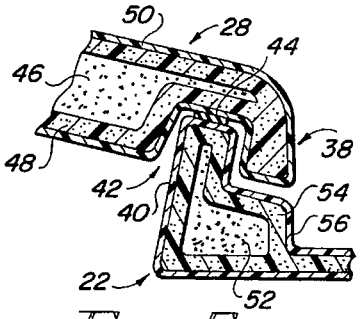
FIG. 5 is a detail side-sectional view of the base support and the elongated door of a distal end thereof.
Figure 4:
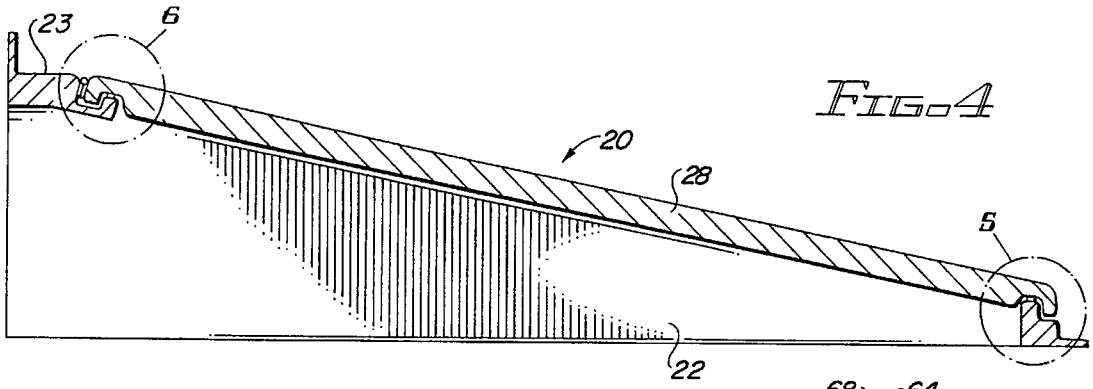
FIG. 4 is a side-sectional view of the bulkhead assembly showing the connection of the entry door to the base support.

FIGS. 4, 5 and 6 are each side cutaway views of the bulkhead door assembly 20 showing relative placement of elongated door 28 about base support 22. In reference to FIG. 5, the distal end of elongated door 28 is shown in detail overlapping the distal end of base support 22. More specifically, lip 38 overlaps and surrounds peripheral bead 40 when the elongated door 28 is in the closed position. As shown in FIG. 2, peripheral bead 40 encircles the entry way into bulkhead door assembly 20.

In further reference to FIG. 5, lip 38 surrounds peripheral recess 42 which is formed into the bottom panel of elongated door 28. Peripheral recess 42 is formed integrally with the bottom side of elongated door 28 to provide a receptacle for peripheral bead 40. Gasket 44 is affixed to the underside of peripheral recess 42 to provide a cushion support between elongated door 28 and base support 22. While gasket 44 may be alternatively affixed to the upper portion of peripheral bead 40, it is preferably positioned within peripheral recess 42 to reduce wear and damage thereon from travel across bulkhead door assembly 20.

Elongated door 28 and base support 22 are generally constructed in similar fashion and of similar materials. In reference to FIG. 5 showing a detail view of elongated door 28, insulation layer 46 is surrounded by a fiberglass panel 48. Fiberglass panel 48 is shown as a continuous sheet. However, it is contemplated that fiberglass panel 48 may actually be a plurality of panels which are so configured and arranged to produce the shape as shown in FIGS. 5 and 6. Fiberglass panel 48 is further surrounded by a gel coat exterior 50 which provides a smooth abrasion resistant surface. Base support 22 is similarly configured. Insulation layer 52 is shown surrounded by fiberglass panel 54 which is further surrounded by gel coat finish 56.

Fiberglass panel 48 is ⅛" thick and may be alternatively constructed out of ABS plastic or epoxy. However, fiberglass has been found to be the most durable and cost effective material. Fiberglass offers a considerable improvement over prior metal doors in that fiberglass does not readily conduct heat or cold. The preferred form of fiberglass is an unsaturated polyester resin hardened with methylethylketoneperoxide.

The gel coat exterior 50 is a molded fiberglass laminate. Gel coat 50 is formed from unsaturated polyester in a styrene monomer. The insulation layer 46 is a two part mixture including polymeric MDI and polyalkoxyesterpolyols. The insulation layer 46 is commonly referred to as urethane having a close cell form. To provide adequate insulative properties, insulation layer 46 is preferably 2" thick. This may be formed as a continuous sheet or in one or two parts.

Figure 7:
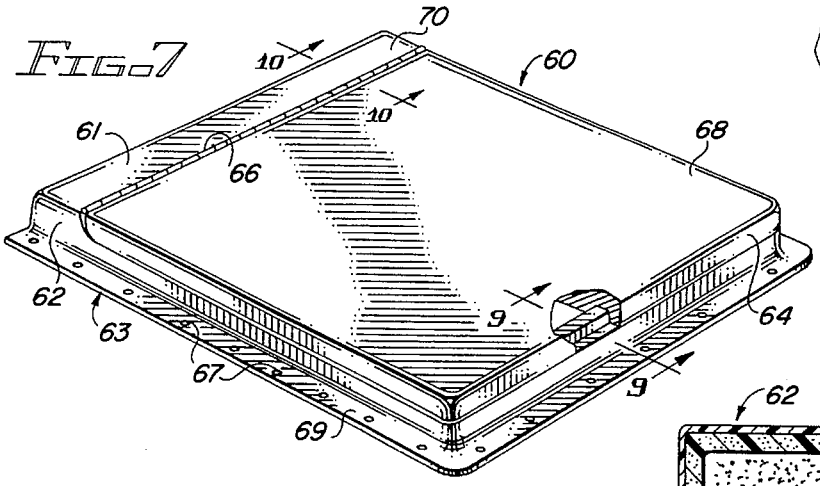
FIG. 7 is an elevated perspective view of a bulkhead door assembly shown in a flush mount configuration.

FIG. 6 exhibits a detail view of the proximal end of bulkhead door assembly 20. An arrow illustrates the movement of elongated door 28 about base support 22. Hinge member 30 attaches elongated door 28 to the base support 22. Peripheral bead 40 is shown disposed within peripheral recess 42 and separated by gasket 44. Lip 38 is configured to freely pass peripheral bead 40. Peripheral bead 40 and peripheral recess 42 cooperate to form a channelled weather strip as a barrier against the elements. To provide a flush surface about elongated door 28 and base support 22 when door 28 is in the closed position, a base support recess 58 is provided adjacent peripheral bead 40. Accordingly, lip 38 may fit within base support recess 58 to provide a further means of elemental protection at the top of the bulkhead door assembly 20. FIG. 7 shows a bulkhead door assembly 60 in accordance with the present invention having a flush mount design. Bulkhead door assembly 60 includes a base support 62 and a bulkhead door 64. Bulkhead door assembly 60 and its corresponding components are generally made in conformance with the above-identified bulkhead door assembly 20. Bulkhead door assembly 60 is also configured and arranged to be supported atop a foundation or for permanent installation as a hatch atop a building. Bulkhead door 64 is attached to base support 62 via hinge member 66. A plurality of bolt holes 67 are provided along bolt flange 69 for securing the bulkhead door assembly to a structure. The bolts are not shown. Bulkhead door assembly 60 incorporates top surface 68 which is a union of the top surface of bulkhead door 64 with and a back top surface 61 of base support 62, (identified as base top 70).

Figure 8:
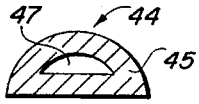
FIG. 8 is cross sectional view of a gasket which is disposed between the door and the base support.

FIG. 8 illustrates the preferred embodiment of gasket 44. Outer covering 45 surrounds an air pocket 47 to provide a cushioning support to the interface between the base support 22 and elongated door 28. In an alternative embodiment, the gasket 44 may be of solid design either convex or rectangular, and formed without the incorporation of air pocket 47. Gasket 44 may be replaced if torn or deteriorated during use. Gasket 44, alternatively referred to as a weather strip, is preferably a neoprene gasket. However, it is contemplated that gasket 44 may be PVC foam or any other suitable material which may provide a cushioned support.

Figure 9:
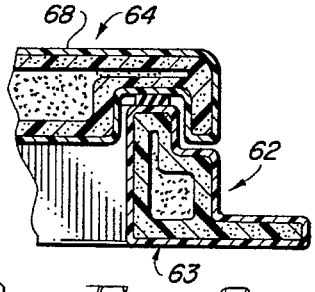
FIG. 9 is a detail side-sectional view of a distal end of the flush mount bulkhead assembly of FIG. 7.
Figure 10:
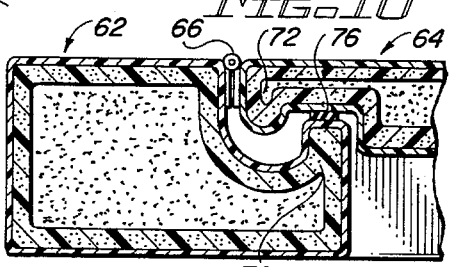
FIG. 10 is a detail side-sectional view of a proximal end of the flush mount bulkhead door assembly of FIG. 7.
Figure 11:
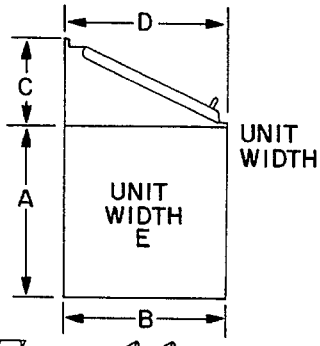
FIG. 11 is a side schematic view of the bulkhead door assembly in a working configuration atop a bulkhead foundation.
Figure 12:
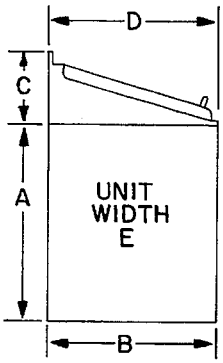
FIG. 12 is a side schematic view of the bulkhead door assembly in another working configuration.
Figure 13:
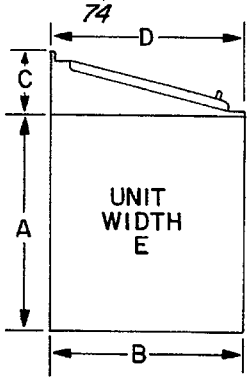
FIG. 13 is a side schematic view of the bulkhead door assembly and yet another working configuration.
Figure 14:
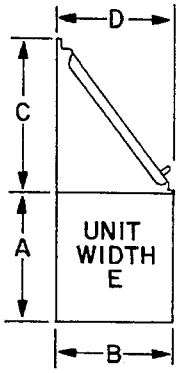
FIG. 14 is a side schematic view of the bulkhead door assembly in yet another working configuration.
Figure 15:
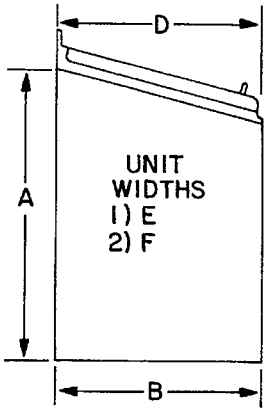
FIG. 15 is a side schematic view of the present invention incorporating a slanted masonry foundation.

FIGS. 9 and 10 are generally similar to FIGS. 5 and 6 and accordingly are not described in detail but for the differences described below. FIG. 9 differs from FIG. 5 in that bulkhead door 64 may be generally perpendicular to base support 62 in accordance with the flush mount design. Accordingly, the top surface 68 of bulkhead door 64 is shown parallel with the bottom surface 63 of base support 62.

FIG. 10 is similar to FIG. 6 except for the flush mount design as shown. Gasket 76 cushions bulkhead door 64 and base support 62 when door 64 is in the closed position. It is contemplated that gasket 76 may be made with the same materials as described for gasket 44 above with reference to FIG. 8. Tail section 72 is designed to freely pass peripheral bead 74 as bulkhead door 64 is raised into an upright position about hinge member 66.

FIGS. 11–15 show schematic variations of anticipated designs of the above-identified invention, although a variety of configurations may be used which are in conformance with the spirit and scope of the present invention. It has been discovered that the following dimensions and unit widths provide functional working embodiments of the invention. The following dimensions also provide protection from the elements simplify construction, and reduce necessary costs. These unit widths are provided in the following table:

| FIGURE | A | B | C | D | E | F |
|---|---|---|---|---|---|---|
| 11 | 40–55" | 60" | 30" | 58" | 47" | N/A |
| 12 | 56–64" | 66" | 22" | 64" | 51" | N/A |
| 13 | 65–72" | 74" | 19.5" | 72" | 53" | N/A |
| 14 | 28–39" | 45" | 52" | 43.25" | 51" | N/A |
| 15 | variable | variable | N/A | 66.5–73.5" | 48.5" | 52.5" |

Figure 16:
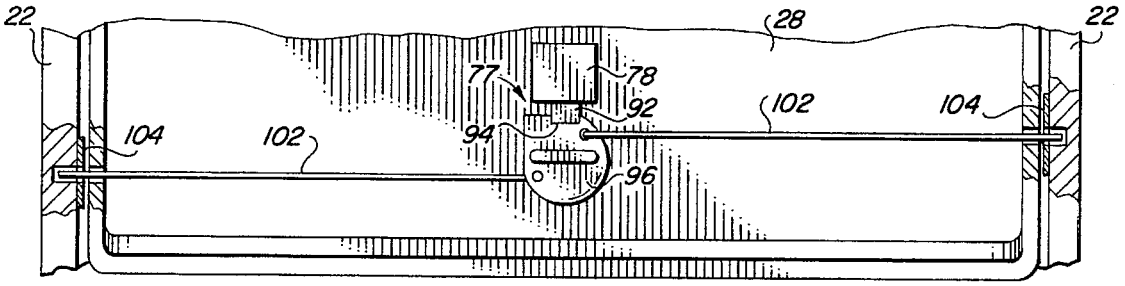
FIG. 16 is a bottom view of the distal end of a bulkhead door showing a locking assembly in the locked position.
Figure 17:
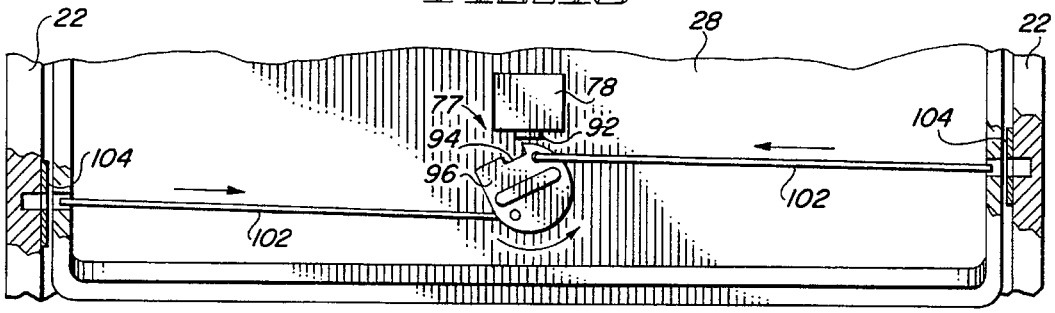
FIG. 17 is a bottom view of the bulkhead door showing movement of the locking assembly into the unlocked position.
Figure 18:
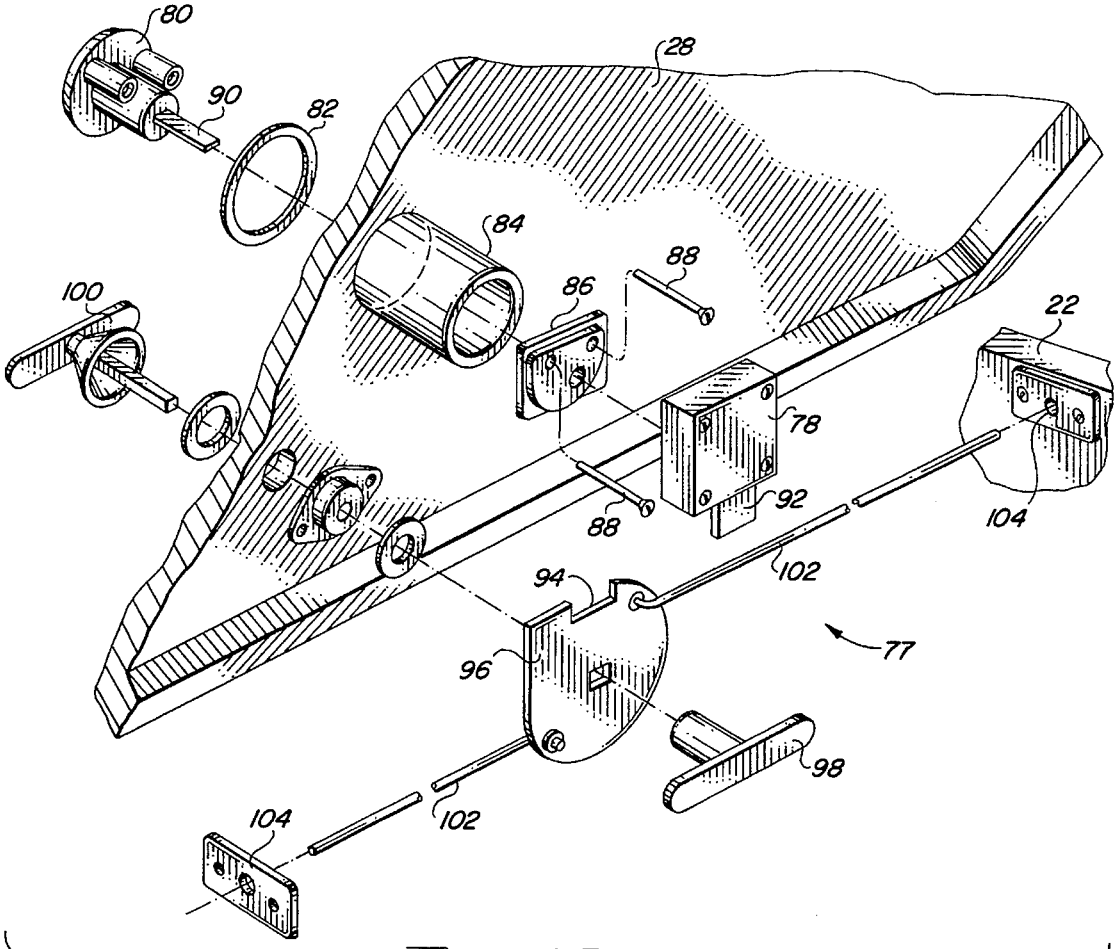
FIG. 18 is exploded perspective view of a locking assembly and handle in accordance with the present invention.

FIGS. 16, 17 and 18 show a locking assembly 77 which is used in accordance with the present invention. More particularly, lockbox 78 is fastened to key receptacle 80 about both sides of elongated door 28. Locking assembly 77 may be used with either door assembly described herein. Key receptacle 80 passes through gasket 82 and is secured within cylinder 84 by retention bracket 86 and a pair of screws 88. After a key (not shown) is inserted into key receptacle 80, key tab 90 turns within lockbox 78 to thereby raise and lower lockbox tab 92 from lockbox 78. Lockbox tab 92 may be raised and lowered from insertion into slot 94 of locking plate 96. Locking plate 96 is then turned via interior handle 98 or exterior handle 100. As either handle turns locking plate 96, a pair of rods 102 are thereby moved inwardly or outwardly with respect to elongated door 28. Rods 102 fit respectively into a pair of receptacles 104 thereby locking elongated door 28 with respect to base support 22. As illustrated, but not specifically numbered, a pair of passage ways are made through base support 22 and elongated door 24 to provide a means of access for the pair of rods 102 into the pair of receptacles 104.

The present invention has been described with reference to the preferred embodiments. However, it is anticipated that modifications and alterations will occur to others upon reading and understanding the preceding detailed description. Accordingly, it is intended that the invention be construed as including all such modifications and alterations insofar as they come within the scope of the appended claims or the equivalents thereof.

I claim:

1. A bulkhead door assembly providing a means of ingress into or egress out of a structure comprising:

a base support having a peripheral flange connected to a building foundation;

a pair of upwardly extending sidewalls integrally connected to alternate sides of said base support;

a header panel integrally connecting said pair of upwardly extending sidewalls; and an elongated door having a proximal end rotatably connected to said header panel about a first hinge member and an insulating substrate sandwiched between a top panel and bottom panel, wherein the bottom panel includes an integrally formed peripheral recess with a resiliently deformable weather strip disposed therein.

2. The bulkhead door assembly according to claim 1, further comprising:

a footer panel integrally connecting said pair of upwardly extending sidewalls at the distal end of said door assembly such that said upwardly extending sidewalls, said header panel, and said footer panel define an opening within said bulkhead door assembly.

3. The bulkhead door assembly according to claim 2 further comprising:

a peripheral bead surrounding the opening within the bulkhead door assembly, wherein said peripheral bead defines an area received within the bottom recess of said elongated door.

4. The bulkhead door assembly according to claim 2 further comprising a peripheral bead surrounding the opening within the bulkhead door assembly, said peripheral bead having an outward surface, an inward surface and a bearing surface.

5. The bulkhead door assembly according to claim 1 further comprising a resilient compression member telescopically joining the elongated door and a first one of said pair of upwardly extending sidewalls.

6. The bulkhead door assembly according to claim 5 further comprising a second resilient compression member telescopically joining the elongated door and a second one of said pair of upwardly extending sidewalls.

7. The bulkhead door assembly according to claim 5 wherein said resilient compression member is a compressed spring.

8. The bulkhead door assembly according to claim 5 wherein said resilient compression member is a pneumatic strut.

9. The bulkhead door assembly according to claim 1 further comprising a lock assembly formed within the elongated door for securably joining said elongated door to said base support.

10. The bulkhead door assembly according to claim 1, said assembly having a distal end and a proximal end with said header panel formed at said proximal end, said bulkhead door assembly further comprising:

a footer panel integrally connecting said pair of upwardly extending sidewalls at the distal end of said door assembly such that said upwardly extending sidewalls, said header panel, and said footer panel define an opening within said bulkhead door assembly; and a peripheral skirt perpendicularly extending outward from each side of each of said sidewalls, said footer panel, and said header panel to thereby provide a means for permanently securing the bulkhead door assembly to a building and the building foundation.

11. The bulkhead door assembly according to claim 1, said elongated door and said header panel forming a planar upper surface of the bulkhead door assembly, said upper surface having a distal end and a proximal end, wherein each of said sidewalls has an upper boundary formed at an acute angle with a lower boundary thereof such that the proximal end of the upper surface slopes toward the distal end thereof.

12. The bulkhead door assembly according to claim 1, said elongated door and said header panel forming a planar upper surface of the bulkhead door assembly, said upper surface having a distal end and a proximal end, wherein each of said sidewalls has an upper boundary formed parallel with a lower boundary thereof such that the planar upper surface is parallel with the lower boundary of each sidewall.

13. The bulkhead door assembly according to claim 1 wherein each of said upwardly extending sidewalls comprises an insulating substrate sandwiched between an inner panel and an outer panel.

14. A bulkhead door assembly providing a means of ingress into or egress out of a lower level of a structure, said structure including a foundation with an outwardly extending jog and a first support wall, said bulkhead door assembly comprising:

an integrally formed base support having a bearing surface for contacting the outwardly extending jog of the structure foundation, said base support having a molded upper surface defining an opening for providing a means of ingress into or egress out of the lower level of the structure; and an elongated door having a proximal end rotatably connected to said molded upper surface by a hinge member and having an insulating substrate sandwiched between a top and bottom panel, wherein the bottom panel includes an integrally formed peripheral recess with a resiliently deformable weather strip disposed therein.

15. The bulkhead door assembly according to claim 14 further comprising a resilient compression member telescopically joining the elongated door and said base support to thereby urge the elongated door into the open position.

16. The bulkhead door assembly according to claim 15 further comprising a second resilient compression member telescopically joining the elongated door opposite from the resilient compression member and said base support.

17. The bulkhead door assembly according to claim 15 wherein said resilient compression member is a pneumatic strut.

* * * * *